United States Patent [19]

Goldstein

[11] Patent Number: 4,564,501

[45] Date of Patent: Jan. 14, 1986

[54] APPLYING PRESSURE WHILE ARTICLE COOLS

[75] Inventor: David Goldstein, Adelphi, Md.

[73] Assignee: The United States of America as represented by the Secretary of the Navy, Washington, D.C.

[21] Appl. No.: 627,938

[22] Filed: Jul. 5, 1984

[51] Int. Cl.[4] ..... B22F 3/14

[52] U.S. Cl. ..... 419/25; 419/26; 419/49

[58] Field of Search ..... 419/25, 26, 49

[56] References Cited

U.S. PATENT DOCUMENTS 3,235,958 2/1966 Gauthron ..... 419/49 X
3,931,382 1/1976 Witkin ..... 419/49 X
4,227,927 10/1980 Black et al. ..... 419/60
4,389,362 6/1983 Larsson ..... 419/49 X

OTHER PUBLICATIONS

Anon., "Hot Isostatic Pressing (HIP) Equipment Advancements for Cemented Tungsten Carbide", *Metal Powder Report,* vol. 38, No. 12, Dec. 1983.

*Primary Examiner*—Stephen J. Lechert, Jr.
*Assistant Examiner*—Matthew A. Thexton
*Attorney, Agent, or Firm*—Robert F. Beers; Kenneth E. Walden; Roger D. Johnson

[57] ABSTRACT

In the consolidation by atmospheric pressure of nickel-titanium alloy powders, the improvement comprising slowly cooling down the consolidated alloy objects under a high pressure.

10 Claims, No Drawings

APPLYING PRESSURE WHILE ARTICLE COOLS

BACKGROUND OF THE INVENTION

This invention relates to powder metallurgy and particularly to the consolidation of metal powders into nearly solid metals.

Although this operation is performed successfully in commercial operations by the simultaneously application of both heat and pressure, it is a costly operation. The process as practiced commercially, is entitled "hot isostatic pressing", and is referred to by the acronym HIP. In the HIP process, the powders are encased in metal containers of the desired configuration which are welded closed after evacuation of the container air. The containers, or "cans" as they are colloquially known, are placed in an autoclave designed for very high pressures and high temperatures to achieve densification of the contained powders. This procedure produces compacts with densities greater than 95% of theoretical and is technically satisfactory. It suffers from the previously mentioned high cost, from the inconvenience of canning and decanning, from the need for the skilled welders required to weld perfectly the thin metal of the can, the limited commercial HIP facilities existing in the nation, and finally the chamber size limitations of the few available HIP facilities. The latter two disadvantages, as well as the high cost, are functions of the difficulty of achieving the desired strength levels and creep resistance in metal structures designed to bear high levels of force or pressure while being operated at high temperatures.

One method to offset the difficulties associated with the HIP process is to compact powders at ambient temperatures, followed by vacuum sintering. This is known as CIP-Sinter and the equipment required is less costly. Although this procedure is successful in some cases, there are instances where it is not. For example, if the powders being compacted do not deform at ambient, there is no resultant mechanical interlocking of deformed particles and the resultant compact is too weak for subsequent handling. The process is then not applicable.

Another version of a technique to avoid HIP operations is the CAP ® process, or "consolidation by atmospheric pressure". This process, as detailed in U.S. Pat. No. 4,227,927, entitled "Powder Metallurgy," which issued to Herbert L. Black et al on Oct. 14, 1980, can produce near theoretical density. In this process the powder is enclosed within an evacuated glass container, which is then embedded within a free flowing refractory powder, such as graphite, and heated within an air atmosphere furnace. Although this process may function well for materials whose diffusion constants are high at usable sintering temperatures, it functions inadequately if the migratory capability of the metal or material atoms is low and little diffusion occurs. In such an instance one might logically reconsider the HIP process to achieve adequate densification of a compact.

Given the difficulties associated with simultaneous application of heat and pressure, as in HIP, and the limitations of pressure applied before heating, as in CIP-Sinter, or heating with an atmospheric pressure differential, as in CAP ®, there remains the desire to achieve HIP level of results in an easier and less costly manner for hard, nondeformable powders with low diffusivity capability.

SUMMARY OF THE INVENTION

Accordingly, an object of this invention is to provide a powder metallurgy process which produces nickel-titanium alloy objects of high density.

Another object of this invention is to provide a powder metallurgy process which produces high density nickel-titanium alloy objects at a lower cost than hot isostatic pressing (HIP) processes.

A further object of this invention is to provide a low cost modification to the consolidation by atmospheric pressure (CAP ®) process which will increase the density of nickel-titanium alloy objects.

These and other objects of this invention are achieved by a modification to the consolidation by atmospheric pressure (CAP ®) process comprising:

after the consolidation by atmospheric pressure has occurred, applying a pressure of 2000 psi or more to the nickel-titanium alloy object while it is allowed to slowly cool down.

DETAILED DESCRIPTION OF THE PREFERRED EMBODIMENT

The present invention comprises a modification to the consolidation by atmospheric pressure (CAP ®) process taught and claimed in U.S. Pat. No. 4,227,927, entitled "Powder Metallurgy," which issued to Herbert L. Black, Mark Somerville, and Jerome Schwertz on October 14, 1980, herein incorporated by reference.

The modified procedure of the present process is limited to the consolidation of nickel-titanium alloy powders wherein the alloys comprise 53 to 62, and preferably from 54 to 58 weight percent of nickel with the remainder of the alloy being essentially titanium. Particle size of the alloy is less than 0.25 mm (−60 mesh) and preferably less than 0.150 mm (−100 mesh).

As in the Black et al process, particles of the selected nickel-titanium alloy are tamped into a glass mold, the mold is evacuated ($0.75\times10^{-4}$ torr) and sealed.

The sealed glass mold is then placed in an open top refractory graphite container and packed with a free flowing refractory powder, preferably graphite flakes or powder.

The glass mold and refractory clay graphite container are heated in an oven at from 900° to 1195° C., preferably from 1165° to 1195° C., under atmospheric pressure until the nickel-titanium powder has densified as much as possible. As the alloy powder densifies the glass mold shrinks.

The next step in the Black et al process is to cool down the mold at atmospheric pressure and separate it from the consolidated metal shape.

The present invention involves the following modification to the Black et al (CAP ®) process. The clay-graphite container is transferred directly to an insulated covered container which is lined with refractory brick. In this manner tha cooling rate of the nickel-titanium alloy object is greatly slowed down.

The refractory brick insulated container is immediately placed into a pressure chamber which is then pressurized. The pressure is left on the glass molds because the refractory brick lined container is not air tight. The pressure is maintained until the temperature of the nickel-titanium alloy has fallen below 900° C.

One application of the present invention is to reduce the cost of preparing nickel-titanium alloy objects by the CAP ® process. Conventionally, the process requires 16 to 24 hours of heating to obtain the 90–92 percent densification necessary before the bare material can be hot worked in air. The heating time, and thus energy cost, can be reduced by using very fine (i.e., −300 mesh) nickel-titanium alloy particles. Unfortunately, nickel-titanium alloys in that form are very expensive. However, if −100 mesh (or even −60 mesh) nickel-titanium alloy is used and heated for four hours, then slowly cooled under pressure, the product will be sufficiently dense for hot working.

Pressures of 2,000 psi or more should work for this step; preferably pressures of 5,000 psi or more, and more preferably of 15,000 psi or more can be used for this step. Pressures of this order can be obtained inexpensively.

Another application of this slow cooling under pressure modification is to obtain greater density in the nickel-titanium alloys objects than can be obtained by the unmodified CAP® process. The conventional CAP® process is used up to the cooling step. The clay-graphite container (including refractory powder, glass molds, nickel-titanium alloy object) is transferred directly to an insulated container which is placed in a pressure chamber. The insulated container is not air tight so that the pressure in the chamber will be felt on the glass molds. A pressure of 15,000 psi or more, preferably 40,000 psi or more, and more preferably from 100,000 to 200,000 psi is applied during cooling. In this manner, a high density product is achievable without hot working.

The general nature of the invention having been set forth, the following examples are presented as specific illustrations thereof. It will be understood that the invention is not limited to these examples but is susceptible to various modifications that will be recognized by one of ordinary skill in the art.

EXAMPLE 1

Use of prior art CAP® process in TiNi powder

A pyrex glass tube of 16 mm inside dimensions, and 1½ wall thickness, and 4 inches in length, with a 12½ mm diameter seal-off pyrex extension fused to it was prepared from cleaned stock. After the tube bottom was closed the total length of the tube was 10 inches. The 4 inch portion was filled with 62.67 grams of −100 mesh TiNi compound and baked during evacuation at 200° C. When the pressure in the tube was $0.75\times10^{-4}$ Torr the upper pyrex seal-off tube was fused, resulting in a capsule of glass containing the loose powders of a TiNi compound identified as Lot 81510. Tap density of the powder was 62% of theoretical. After embedding the tube in a plumbago crucible filled with Dixon 1101 flake graphite it was heated by placing the assembly in a Globar heated furnace with an air atmosphere. The heating cycle was 15 hours at 950° C., followed by furnace cooling to 600° C. After removal of the crucible from the furnace the glass capsule was removed from the flake graphite bed and air cooled. During the air cooling, the glass envelope self stripped due to difference of thermal contraction rates of glass and TiNi compound.

Incipient fusion of the powder occurred, resulting in an integral bar with no significant increase in density of the powdered TiNi.

This example/clearly demonstrated the migration of the TiNi atoms from one particle of powder to another at their interface, at a temperature of 950° and a pressure of 14.7 pounds per square inch. It further demonstrated that this process a straightforward CAP® procedure, does not produce the desired significant densification at this temperature. It was thus an inadequate substitute for a HIP procedure. This piece was clearly a candidate for further densification by this invention.

EXAMPLE 2

Prior CAP® process on TiNi powder

The example given above was repeated with different TiNi powder lot, and using a higher sintering temperature. Powder lot 81512, a coarser grade containing powders between −60 and +100 mesh was treated identically to the previous example except that the heating cycle was 22 hours at temperatures fluctuating between 1095° and 1122° C. After sintering, this specimen was fractured by mechanical blows, and the surface examined optically. The bar interior showed incipient fusion and also the essentially unchanged, roughly spherical, particles of TiNi powder as were initially charged into the pyrex tube.

This demonstration of no significant improvement in densification over Example 1, despite longer sintering at a significantly higher temperature, illustrates the need for increased pressure during sintering if near theoretical densities are to be achieved when using coarser powders.

EXAMPLE 3

Warm working ability test for TiNi

To show that pressures that are well under those frequently used for HIP operations (15–30,000 psi) will cause flow of TiNi material, a wire of 0.040 inch diameter was suspended from a clamp and loaded with a 6.8 pound weight. This produced a stress of 7000 pounds per square inch on a cross section of the wire, which was of diameter 6 times the particle size of the power used in Example 2. At a temperature of 750° C. (faint red glow) the wire began to creep, elongating rapidly at a temperature of 800° C. (red glow). This demonstrates that pressurization of the cold wall chamber containing the cooling CAP® product will further densify at temperatures as low as 750° C.

The foregoing examples illustrate that densification of powders may be achieved in relatively low cost equipment by this pressure process following the CAP® procedure. Unlike the standard CAP® and CIP-Sinter processes, which are low cost, but do not necessarily result in total densification, this process will enable easy removal from the 1 atmosphere pressure chamber of the increased density workpiece and its direct hot extrusion or swaging, rolling or drawing. No decanning procedure is required before hot work in air.

Densification at temperatures below the sintering temperature by the application of isostatic pressure is contrary to the wisdom of most practitioners of powder metallurgy consolidation techniques. The accepted way of obtaining the pressures required for consolidation has always been to apply the pressure, either isostatically or uniaxially, prior to and during reaching maximum pressure. Hence this invention details an unexpected procedure with unexpected results.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. In a process for consolidating powder metals comprising the steps for (a) placing unconsolidated powder nickel-titanium alloy comprising from 53 to 62 weight percent of nickel the remainder of the alloy being essentially titanium in a sealable glass mold which becomes plastic upon heating, (b) evacuating the atmosphere from the powder filled mold, (c) sealing the mold, (d) placing the mold in a open top refractory container and packing with free flowing refractory powder selected to freely flow at all the temperatures used in the process, (e) heating the mold and contents of the mold to a temperature at which sintering of the powder metal takes place and holding at this temperature for a time sufficient to cause substantially complete densification of the powder nickel-titanium alloy, (f) cooling and removing the mold to recover a dense article, and whereby the glass mold is supported by the free flowing refractory powder as the mold becomes plastic and shrinks in volume as its contents densify, the improvement comprising:

after step (e), transferring the open top refractory container, refractory powder, glass mold, and nickel-titanium object directly into an insulated, refractory lined covered container and then placing the covered container into a pressure chamber and applying an isostatic pressure of 2,000 psi or more to the nickel-titanium alloy object while it slowly cools down.

2. The process of claim 1 wherein the nickel-titanium alloy comprises from 54 to 58 weight percent of nickel with the remainder being essentially titanium.

3. The process of claim 1 wherein a pressure of 5,000 psi or more is applied to the nickel-titanium alloy object while it cools.

4. The process of claim 1 wherein a pressure of 15,000 psi or more is applied to the nickel-titanium alloy object while it cools.

5. The process of claim 1 wherein a pressure of 40,000 psi or more is applied to the nickel-titanium alloy object while it cools.

6. The process of claim 1 wherein a pressure of 100,000 to 200,000 psi is applied to the nickel-titanium alloy object while it cools.

7. The process of claim 1 wherein an inert atmosphere is used in the pressure chamber during the cooling under pressure of the nickel-titanium alloy object.

8. The process of claim 1 wherein the initial temperature of the open top refractory container, refractory powder, glass mold, and nickel-titanium alloy object is from 900° to 1195° C. when they are placed into the insulated, refractory lined covered container and the isostatic pressure is maintained until the temperature of the nickel-titanium alloy object has slowly cooled to a temperature below 800° C.

9. The process of claim 8 wherein the initial temperature of the open top refractory container, refractory powder, glass mold, and nickel-titanium object is from 1165° to 1195° C. when they are placed into the insulated, refractory lined covered container.

10. The process of claim 1 wherein the initial temperature of the open top refractory container, refractory powder, glass mold, and nickel-titanium alloy object is from 1165° to 1195° C. when they are placed into the insulated, refractory lined covered container and the isostatic pressure is maintained until the temperature of the nickel-titanium alloy object has slowly cooled to a temperature below 900° C.

* * * * *